United States Patent [19]

Bunegar et al.

[11] 4,077,896

[45] Mar. 7, 1978

[54] WAX-STRIPPING CLEANING COMPOSITION

[75] Inventors: Frederick J. Bunegar, Denver, Colo.; Sheila A. Tesch, St. Paul, Minn.

[73] Assignee: Minnesota Mining and Manufacturing Company, St. Paul, Minn.

[21] Appl. No.: 541,255

[22] Filed: Jan. 15, 1975

[51] Int. Cl.[2] ..... C11D 7/50; C11D 7/32; C11D 7/26

[52] U.S. Cl. ..... 252/90; 252/541; 252/544; 252/548; 252/DIG. 3; 134/40

[58] Field of Search ..... 134/40; 252/544, 548, 252/541, DIG. 3, DIG. 10, 305, 90, 163, 170, 171

[56] References Cited

U.S. PATENT DOCUMENTS

| | | | |
|---|---|---|---|
| 2,850,461 | 9/1958 | Bloch et al. | 252/364 |
| 3,546,124 | 12/1970 | Fleischer | 252/171 |
| 3,839,234 | 10/1974 | Roscoe | 257/170 |
| 3,881,948 | 5/1975 | Schoenholz et al. | 134/40 |
| 3,882,038 | 5/1975 | Clayton et al. | 252/170 |
| 3,886,099 | 5/1975 | Hall | 252/548 |

*Primary Examiner*—Harris A. Pitlick

*Attorney, Agent, or Firm*—Cruzan Alexander; Donald M. Sell; Richard Francis

[57] ABSTRACT

A heavy-duty cleaning composition, especially suited for removing soil from baseboards, ceramic tile and walls and other hard-to-get-at areas and for removing wax or finish coatings from floors, baseboards and corners, contains (1) an aqueous solvent system including a water-soluble monobutyl glycol ether organic solvent and (2) a primary amine. Preferably, the composition also contains a water-soluble compatible thickening agent, sufficient compatible surfactant to enhance wetting the surface being cleaned and sufficient compatible water-soluble film-forming resin to inhibit rapid evaporation of the organic solvent and the amine.

10 Claims, No Drawings

WAX-STRIPPING CLEANING COMPOSITION

BACKGROUND OF THE INVENTION

Soil and wax removal, especially from inconveniently cleaned places such as corners, baseboards, stairs, and the like, have long been a perplexing problem for both the housewife and maintenance personnel who have charge of cleaning commercial and industrial buildings.

Recent developments and improvements in floor waxes and polishes have created a serious removal problem which heretofore has gone all but unsolved. The new wax and polish products are formulated to improve their hardness, stability, abrasion resistance and durability. It is these very properties that have made removal of such improved products difficult, if not impossible.

Some waxes and polishes have built-in removal aids which make them insoluble in alkaline or neutral media but soluble in acid media. Such removal aids may permit the waxed or polished surface to be cleaned with conventional alkaline cleaning compositions and the removal of the surface coating with an acid cleaning composition. Not all waxes and polishes are so formulated, however.

Most commercial or industrial waxes and polishes, on the other hand, are required for economic reasons to resist stripping or removal for long periods of time. After application, these products are damp mopped either with clear water or a neutral or mild detergent to remove surface dirt without removing the finish. The finish may then be mechanically polished to renew its glossy surface. Such a wax or polish finish is typically used for several months without replacement. When the soil build-up on this surface becomes unsightly or the finish layer is actually worn through, it becomes necessary to strip (remove completely) and recoat.

Floor finishing compositions contain any of a wide variety of substances (e.g., polymeric materials) known to provide protective coatings. Nearly all of these substances are water-insoluble or may be rendered so. They are generally in the form of a solution or an emulsion when they are applied. As the coating dries, the solvent will evaporate, leaving a water-resistant protective finish coating.

Some typical present-day polymers used in floor finishing compositions are formed by copolymerizing styrene, ethyl acrylate, methyl methacrylate, acrylonitrile and ethylene monomers. Some waxes are based upon mixtures of natural materials such as Carnauba wax and synthetic polymeric materials such as polyacrylates or polystyrene. Some common wax formulations include Carnauba wax and an alkali-soluble resin. Other compositions include synthetic wax compositions consisting of Fischer-Tropsch waxes, oxidized micro-crystalline waxes, polyethylene resins, oil-soluble resins, etc. Emulsion floor finish compositions may include styrene, modified shellac, styrene-acrylate copolymer mixtures, acrylate compositions, acrylate and acid-sensitive alkali-resistant mixtures. A commercially successful cleaning and stripping composition must not only be effective on these finish coatings, but it must also not harm conventional floor surface materials to which these finishes are applied. Such floor surface materials include vinyl, vinyl asbestos and asphalt floor coverings, concrete, terrazzo, wood, etc.

The known cleaners or removers for such wax and finish coatings have been classified into five general types: (1) soap (e.g., fatty acid soap and caustic compositions), (2) detergent (e.g., fatty acid soap and alkanolamide compositions), (3) detergent plus builders, (4) detergent plus builders plus solvent such as butyl "Cellosolve" or isopropyl alcohol and (5) acid.

For a description of such cleaning compositions and this classification system, see *Proceedings of the 50th Mid-Year Meeting of the Chemical Specialties Manufacturers Association, Inc.*, New York, May 18–20, 1964, pages 126–133 the paper entitled "Removal of Modern Floor Polishes" by George H. Gray and Joe Domin. This paper reveals that, while freshly finished floor surfaces are fairly easy to strip of their finish, aged finishes are difficult, if not impossible, to remove with only a stripping or cleaning composition, i.e., without the aid of mechanical abrading as with a scrubbing machine fitted with an abrasive pad. *Technical Bulletin* No. 2202 of the Ultra Division of Witco Chemical Co. also discloses some known wax stripping compositions. This article suggests that a successful wax stripping composition must contain inorganic alkaline builders and organic detergents.

U.S. Pat. No. 3,839,234 discloses a multi-purpose cleaning concentrate, suggesting the inclusion of some of the ingredients of the present invention among a multitude of other ingredients which have been found to be either ineffective or detrimental to the cleaning efficacy of the composition of the present invention.

SUMMARY OF THE PRESENT INVENTION

It has been discovered that a wax-stripping cleaning composition can be formulated from (1) a water/organic solvent system including a water-soluble monobutyl glycol ether organic solvent such as 2-butoxyethanol (commercially known as butyl "Cellosolve") and (2) a water-soluble primary amine such as an alkanolamine (e.g., monoethanolamine). This cleaning composition will quickly remove built-up wax and soil from baseboards, resilient tile, terrazzo-type floors and floors of other conventional materials, without harming their surfaces. Such removal has been found to be more effective and faster than previously known cleaning compositions. The cleaning composition of the invention eliminates the need for using abrasive mechanical cleaning devices which have typically been used in conjunction with prior art wax stripping and cleaning compositions because of their inefficiency. Moreover, the cleaning composition of the invention is far less alkaline (i.e., it has a pH of less than 12) than conventional cleaning compositions which contain alkaline builders. Therefore it does not harm the surface from which wax and soil is being removed, and, for most individuals or normal sensitivity, the hands of the user.

The wax-stripping cleaning composition of the invention preferably also contains sufficient water-soluble compatible thickening agent to prevent the composition from running when it is applied to a vertical surface. The composition of the invention may also contain sufficient compatible surfactant to enhance the wetting of the surface being cleaned. The composition of the invention may also contain sufficient compatible water-soluble film-forming resin to inhibit rapid evaporation of the organic solvent and the amine.

DETAILED DESCRIPTION OF THE INVENTION

The solvent system of the composition of the invention consists essentially of a major portion of water and a minor amount of a water-soluble monobutyl glycol ether organic solvent. Suitable water-soluble monobutyl glycol ether organic solvents for this purpose include 2-butoxyethanol (known under the commercial designation butyl "Cellosolve"), diethylene glycol monobutyl ether (known under the commercial designation as butyl "Carbitol"), butoxethoxy propanol and mixtures of these. Alkylene glycol ethers having an alkyl radical containing less than 4 carbon atoms (i.e., less than a butyl radical, e.g., a methyl radical) will not have sufficient solvent properties for many floor finishes and thus are unacceptable. The water-soluble monobutyl glycol ether organic solvent is preferably contained in the composition at about 1% to 25% by weight. At less than 1% organic solvent, its effectiveness in the composition is marginal. It is presently uneconomical to use more than 25% organic solvent in the cleaning composition, although such compositions are effective.

The primary amine useful in the composition defined above has the general formula $NH_2R$ wherein R is a lower alkyl group having from 1 to 5 carbon atoms (e.g., a methyl, ethyl, propyl, butyl or a pentyl group), a monohydroxylalkyl group having from 1 to 3 carbon atoms (e.g., $—CH_2OH$, $—C_2H_4OH$ and $—C_3H_6OH$), an aminoalkyl group having from 2 to 3 carbon atoms (e.g., $—C_2H_4NH_2$, and $—C_3H_6NH_2$), or hydrogen (i.e., $NH_3$). Exemplary primary amines falling within this definition and being useful in the invention include primary alkyl amines such as methylamine, ethylamine, propylamine, butylamine, and pentylamine, alkylene amines such as ethylene diamine, alkanolamines such as monoethanolamine, and the non-organic compound, ammonium hydroxide. it is preferred to use alkanolamines because they are not skin irritants and do not have an undesirable ammonia odor. The primary amine preferably comprises 2–20% (most preferably 3–10%) by weight of the composition of the invention. At less than 2% amine, its effectiveness is marginal, and it would presently be economically unsound to use more than 20% amine in the cleaning composition of the invention.

Even though the stated minimum for the monobutyl glycol ether solvent has been indicated to be 1% and the minimum for the amine to be 2%, a composition containing the stated minimum of each of these components would not be acceptable. For example, if 1% monobutyl glycol ether solvent is to be used, much more than 2% amine must be used to obtain an effective concentration of these active ingredients. The minimum quantity of each the amine and the monobutyl glycol ether organic solvent in a given composition may be calculated by the expression $(x+1)y = 25$, where "$x$" represents the parts by weight organic solvent and "$y$" represents the parts by weight primary amine, and where "$x$" is greater than zero and "$y$" is greater than 1. The expression for the preferred minimum quantity of each of these components in a given composition is $x(x-1) = 36$ where "$x$" is greater than 1 and "$y$" is greater than 2.

A preferred composition contains from 10 to 20 parts by weight 2-butoxy-ethanol and 3 to 10 parts monoethanol amine.

It is especially advantageous to utilize a small amount of compatible surfactant in the composition of the invention to enhance its ability to wet the surface being cleaned. This surface will generally by hydrophobic due to the nature of the wax or polish covering it and, in some cases, form a thin oily surface layer which may be caused by any of a variety of soiling situations. Such surfactants will generally be anionic or nonionic in nature. Commercially available suitable surfactants include nonionic surfactants, such as ethoxylated secondary alcohol surfactants, e.g., that sold under the tradename "Tergitol" 15-S-9, alkyl phenol ethylene oxide condensate surfactants, e.g., that sold under the tradename "Triton" X 100, anionic surfactants such as alkyl benzene sulfonates, e.g., that sold under the trade designation "Ultrawet" 100, lauryl sulfates such as that sold under the trade designation "Richanol" A, and long chain fatty acid salts, i.e., tallow or coconut oil soaps. The term "surfactant" is intended to include synthetic or natural soaps, detergents and surfactants. The surfactant is preferably contained in the composition on the order of about 0.5–2% (most preferably about 1%).

It is also especially advantageous to use a compatible water-soluble film-forming resin to inhibit the rapid evaporation of the water-soluble organic solvent and the primary amine while the composition is applied to the surface being cleaned. This resin keeps these volatile active ingredients in contact with the surface for a longer period of time, thus reducing the required effective amount of these materials in the composition. Suitable film-forming resins include sodium carboxymethyl cellulose and hydroxymethyl cellulose. Such film-forming resins will be contained in the composition in small quantities, e.g., between 0.05 and 0.5% by weight (preferably between 0.1 and 0.3). Amounts of these resins in excess of 2–3% may cause the composition to gel (a situation which may or may not be desirable) and may also leave an undesirable residue.

It is particularly advantageous to also include a compatible thickening agent to render the viscosity of the composition of the invention such that it may be applied to a vertical surface, e.g., a baseboard, and not run therefrom. If such running occurs, the residence time (and thus the efficacy) of the composition with respect to the baseboard wax build-up and soil would be reduced and/or the composition may run into areas where it is not wanted, e.g., upon a carpeted surface. It has been found in practice that, if the composition has a viscosity of at least 500 cps at 25° C, it will not run. A thickening agent which has been found to be quite suitable is colloidal magnesium aluminum silicate (sold under the trade designation "Veegum" T). This particular thickening agent was found to be effective at a concentration of about 0.3% to about 0.6% by weight, but this concentration may vary with other known thickening agents.

For use as a stripping composition, the composition of the invention typically has a non-aqueous portion of about 10% to about 35% by weight. The composition of the invention can, of course, be made and sold as a concentrated solution having a higher non-aqueous concentration, even as high as 50% or greater.

In use, the diluted composition it typically sprayed as an aerosol upon the surface to be cleaned. The spraying can be accomplished by conventional mechanical spraying devices or by using an aerosol dispensing container with a sufficient amount of suitable aerosol propellant such as a low boiling chloro-, fluoro- substituted alkane (e.g., "Freon" 12) or low boiling alkanes or mixtures thereof such as a mixture of isobutane and propane.

The composition of the invention may contain other conventional additives. For example, the composition of the invention may contain a colorant to provide a more aesthetic appearance, a fragrance to provide a more acceptable smell and a preservative to prevent bacterial growth in the solution and a suitable agent to eradicate germs, mold, mildew etc., from the surface being cleaned. Such components are well known in the art and the specific amounts of each will be within the knownledge of the artisan.

Additives which render the composition highly alkaline should be avoided to maintain the relatively mild alkalinity resulting from the ingredients described above. The compositions of the invention will typically have a pH value of less than 12.

Understanding of the invention will be further facilitated by referring to the subsequent examples, which indicate, without thereby limiting, ways in which the invention may be practiced and wherein all parts are by weight unless otherwise indicated.

EXAMPLE 1

A preferred composition according to the invention was prepared of the following ingredients:

| Ingredients | Parts |
|---|---|
| water | 67.5 |
| sodium carboxymethyl cellulose (Hercules Inc. grade 7H) | 0.2 |
| bactericide (sold under the trade designation "Dowcide" A) | 0.1 |
| thickening agent (sold under the trade designation "Veegum" T as a 4% aqueous dispersion) | 11.2 |
| 2-butoxyethanol (butyl "Cellosolve") | 15.0 |
| monoethanolamine | 5.0 |
| nonionic surfactant ("Tergitol" 15-S-9) | 1.0 |

This composition was charged into a 24 oz. unlined tin-plated steel aerosol container with 9 parts propellant (90% isobutane and 10% propane). The composition was then sprayed uniformly on a soiled vinyl plastic baseboard, which also had a heavy wax build-up, and allowed to remain for 3–5 minutes, after which time the wax build up and soil were noted to be softened or loosened sufficiently for removal. The composition and loosened soil were easily removed with a mild abrasive cleaning pad. Then, a damp cloth was used to remove substantially all of the composition from the cleaned surface.

EXAMPLES 2–32

Examples 2–32 were prepared to determine the minimum effective concentration of water-soluble organic solvent and primary amine in a composition according to the invention. The composition and performance of each of these examples is shown in Table I. In Table I, "MEA" is monoethanol amine and "BC" is butyl "Cellosolve". Examples 2–32 contain the same ingredients as Example 1 except the amine and organic solvent are varied as shown in Table I.

EVALUATION

Examples 2–32 were evaluated as wax-stripping compositions by first coating 9 × 9 inch squares of white vinyl asbestos floor tile with fifteen coating layers of an acrylic type floor finish (sold under the trade designation "Complete" by S. C. Johnson Co.), drying the coated floor tiles in a forced air oven after each coating at a temperature of 200° F for ½ hour, following the 15th coating layer the coated tiles were dried at 200° F for 24 hours, resulting in a dry coating thickness of about 4 mils. Thereafter, three test drops (about 0.1 ml in volume) of each formulation were dropped on the floor tile, one allowed to remain on the finished surface about 5 minutes, one about 10 minutes and the other about 15 minutes.

It has been determined in practice that the rate at which a formulation removed this finish indicated its degree of utility. The following classification system was used:

| Classification | Removal Rate |
|---|---|
| superior (s) | 100% removed after 10 minutes and at least 50% removed after 5 minutes |
| good (g) | 100% removed after 15 minutes and at least 50% removed after 10 minutes |
| acceptable (a) | 75% removed after 15 minutes and at least 25% removed after 10 minutes |
| unacceptable (u) | less than 75% removed after 15 minutes |

Table I

Examples 2–32

| Example | Percent MEA | Percent BC | Classification | % Removed Minutes 5 | 10 | 15 |
|---|---|---|---|---|---|---|
| 2 | 3 | 15 | g | | 75 | 100 |
| 3 | 5 | 8 | g | | 75 | 100 |
| 4 | 3 | 8 | a | | 25 | 100 |
| 5 | 9 | 15 | s | | 100 | 100 |
| 6 | 5 | 22 | s | | 100 | 100 |
| 7 | 9 | 22 | s | | 100 | 100 |
| 8 | 3 | 22 | g | | 75 | 100 |
| 9 | 9 | 8 | s | 100 | 100 | 100 |
| 10 | 9 | 0 | u | | 0 | 10 |
| 11 | 9 | 1 | u | | 0 | 20 |
| 12 | 0 | 22 | u | | 0 | 10 |
| 13 | 1 | 33 | u | | 0 | 20 |
| 14 | 2 | 22 | u | | 25 | 50 |
| 15 | 9 | 2 | u | | 25 | 50 |
| 16 | 2.5 | 22 | a | | 25 | 75 |
| 17 | 9 | 3 | u | | 25 | 50 |
| 18 | 2.5 | 7 | u | | 25 | 50 |
| 19 | 9 | 5 | g | | 50 | 100 |
| 20 | 15 | 5 | s | | 75 | 100 |
| 21 | 15 | 3 | g | | 50 | 100 |
| 22 | 9 | 4 | u | | 25 | 50 |
| 23 | 15 | 1 | u | | 25 | 50 |
| 24 | 20 | 0 | u | | 25 | 50–75 |
| 25 | 20 | 1 | a | | 25 | 75 |
| 26 | 15 | 2 | a | | 25 | 75 |
| 27 | 9 | 4.5 | a | | 25 | 75 |
| 28 | 3 | 5 | u | | 0 | 10 |
| 29 | 5 | 6 | u | | 0 | 10 |
| 30 | 5 | 5 | u | | 0 | 10 |
| 31 | 4 | 7 | u | | 0 | 10 |
| 32 | 4 | 6 | u | | 0 | 10 |

Example 33

| Ingredients | Parts |
|---|---|
| water | 61.0 |
| sodium carboxymethyl cellulose | 0.2 |
| bactericide ("Dowcide" A) | 0.1 |
| thickening agent ("Veegum" T as a 4% aqueous dispersion) | 11.2 |
| 2-butoxyethanol (butyl "Cellosolve") | 15.0 |
| methylamine (40% in water) | 12.5 |

The cleaning composition of this Example, evaluated as described above, had a "superior" evaluation.

EXAMPLES 34–52

Examples 34–52 shown in Table II below were prepared according to Example 1 except the amine and organic solvent were those identified in Table II. These compositions were evaluated using the test panels and procedure described above. Results were observed as the amount (%) of floor finish removed after 10 and 15 minutes, respectively.

TABLE II

Examples 34–52

| Ex. | Amine | % | Organic Solvent | Solvent Tradename | % | % Removal 10 min. | % Removal 15 min. |
|---|---|---|---|---|---|---|---|
| 34 | ammonia[1] | 5 | $C_4H_9OC_2H_4OH$ | Butyl Cellusolve | 15 | 50 | 100 |
| 35 | " | 10 | " | " | 15 | 100 | 100 |
| 36 | monoethanol-amine | 5 | " | " | 15 | 50 | 100 |
| 37 | " | 5 | $C_4H_9O[C_2H_4O]_2H$ | Butyl Carbitol | 15 | 50 | 100 |
| 38 | " | 5 | $CH_3O[C_2H_4O\ _2H$ | Methyl Carbitol | 15 | 0 | 10 |
| 39 | " | 5 | $CH_3OC_2H_4OH$ | Methyl Cellosolve | 15 | 0 | 10 |
| 40 | " | 5 | $C_2H_5O[C_2H_4O]_2H$ | Carbitol | 15 | 0 | 10 |
| 41 | " | 5 | $C_2H_5OC_2H_4OH$ | Cellosolve | 15 | 0 | 20 |
| 42 | " | 5 | $C_2H_5OCH_2CH_2OCH_2CH_2OC_2H_5$ | Diethyl Carbitol | 15 | 25 | 50 |
| 43 | " | 5 | $CH_3OCH_2CH(CH_3)OH$ | "UCAR Solvent LM" | 15 | 25 | 50 |
| 44 | monoethanol-amine | 5 | $CH_3OCH_2CH(CH_3)OCH_2CH(CH_3)OH$ | "UCAR Solvent 2LM" | 15 | 25 | 50 |
| 45 | " | 5 | $C_4H_9OC_2H_4OCH_2CH(CH_3)OH$ | Butoxy Ethoxy Propanol | 15 | 50 | 100 |
| 46 | monoisopro-panolamine | 5 | $C_4H_9OC_2H_4OH$ | Butyl Cellosolve | 15 | 50 | 100 |
| 47 | diisopropyl-amine | 5 | " | " | 15 | 0 | 25 |
| 48 | ethylene diamine | 5 | " | " | 15 | 50 | 100 |
| 49 | morpholine | 5 | " | " | 15 | 0 | 25 |
| 50 | diethanol-amine | 5 | " | " | 15 | 0 | 25 |
| 51 | triethanol-amine | 5 | " | " | 15 | 0 | 25 |
| 52 | dimethyl-aminopro-pylamine | 5 | " | " | 15 | 50 | 100 |

[1]concentrated ammonium hydroxide (28% $NH_3$)

EXAMPLE 53

Five parts monoethanolamine, 15 parts butyl "Cellosolve" and 80 parts water were mixed to provide a cleaning composition which was evaluated as described above. This composition had a "good" classification.

What is claimed is:

1. A sprayable liquid cleaning composition suitable for removing heavy wax build-up and soil from baseboards, cleaning floors and stair areas where floor cleaning machines cannot reach, cleaning soap residue from ceramic tile and grouting and shower areas, and in other areas, consisting essentially of 1. 1–25 parts by weight of a water-soluble monobutyl glycol ether organic solvent;
2. 3–10 parts by weight of a water-soluble primary amine having the formula $NH_2R$ wherein R is a lower alkyl group having from 1 to 5 carbon atoms, a monohydroxyalkyl group having from 1 to 3 carbon atoms, an aminoalkyl group having from 2 to 3 carbon atoms or hydrogen, the pH of said composition being less than 12 wherein the minimum quantity of said amine and said monobutyl glycol ether organic solvent in said composition is calculated by the expression $(x+1)y = 25$, where "$x$" represents the parts by weight organic solvent and "$y$" represents the parts by weight primary amine per 100 parts by weight of said composition, and where "$x$" is greater than zero and "$y$" is greater than 1; and
3. the remainder of 100 parts being water.

2. The cleaning composition defined in claim 1 wherein said monobutyl glycol ether is selected from the group consisting of 2-butoxyethanol, diethylene glycol monobutyl ether, and butoxyethoxy propanol.

3. The cleaning composition defined in claim 1 also including sufficient water-soluble compatible thickening agent to render its viscosity at least 500 cps.

4. The cleaning composition of claim 3 wherein the thickening agent is colloidal magnesium aluminum silicate.

5. The cleaning composition defined in claim 1 also including sufficient compatible surfactant to enhance wetting of the surface being cleaned.

6. The cleaning composition of claim 5 wherein the surfactant is an anionic surfactant or a nonionic surfactant.

7. The cleaning composition of claim 5 wherein said surfactant is contained in said cleaning composition in concentration of up to 10%, by weight, of the total weight of the composition.

8. The cleaning composition of claim 1 also including sufficient compatible water-soluble film-forming resin to inhibit evaporation of the water-soluble monobutyl glycol ether organic solvent and the primary amine for a sufficient time to permit substantially complete softening of wax build-up being removed wherein said film-forming resin is selected from the group consisting of sodium carboxymethyl cellulose and hydroxymethyl cellulose.

9. The cleaning composition of claim 1 wherein said primary amine is monoethanolamine.

10. A sprayable liquid cleaning composition contained within an aerosol container being suitable for removing heavy wax build-up and soil from baseboards, cleaning floors and stair areas where floor cleaning machines cannot reach, cleaning soap residue from ceramic tile and grouting and shower areas, and in other areas, consisting essentially of:

1. about 70 parts by weight water;
2. about 0.1–0.3 parts by weight sodium carboxymethyl cellulose;
3. about 0.3–0.6 parts by weight colloidal magnesium aluminum silicate thickening agent;
4. about 10–20 parts by weight 2-butoxyethanol;
5. about 3–10 parts monoethanolamine;
6. about 1 part by weight nonionic surfactant;
7. sufficient aerosol propellant to expel said composition from an aerosol container.

* * * * *

UNITED STATES PATENT AND TRADEMARK OFFICE

CERTIFICATE OF CORRECTION

PATENT NO. : 4,077,896
DATED : March 7, 1978
INVENTOR(S) : Frederick J. Bunegar and Sheila A. Tesch It is certified that error appears in the above-identified patent and that said Letters Patent are hereby corrected as shown below:

Page 6, line 19 (Col. 3, line 34), "it is" should read --It is--.

Page 7, line 10 (Col. 3, line 57), "x(x-1)" should read --x(y-1)--.

Page 9, line 14 (Col. 4, line 56), "it typically" should read --is typically--.

Page 12, Table 1, Example 13, under the heading "BC", (Col. 6, Table 1, Example 13, under the heading "BC"), "33" should read --22--.

Signed and Sealed this
*Twentieth* Day of *June 1978*

[SEAL]

*Attest:*

RUTH C. MASON
*Attesting Officer*

DONALD W. BANNER
*Commissioner of Patents and Trademarks*